US010165794B2

(12) United States Patent
Besso et al.

(10) Patent No.: US 10,165,794 B2
(45) Date of Patent: Jan. 1, 2019

(54) SMOKING ARTICLE WITH VISIBLE CONTENTS

(71) Applicant: PHILIP MORRIS PRODUCTS S.A., Neuchatel (CH)

(72) Inventors: Clement Besso, Neuchatel (CH); Alexandre Camus, Colombier (CH); Dorothy Tritz, Yverdon-les-Bains (CH); Charles Kuersteiner, Jouxtens-Mezery (CH)

(73) Assignee: Philip Morris Products S.A., Neuchatel (CH)

( * ) Notice: Subject to any disclaimer, the term of this patent is extended or adjusted under 35 U.S.C. 154(b) by 556 days.

(21) Appl. No.: 14/355,633

(22) PCT Filed: Nov. 6, 2012

(86) PCT No.: PCT/EP2012/004623
§ 371 (c)(1),
(2) Date: May 1, 2014

(87) PCT Pub. No.: WO2013/068100
PCT Pub. Date: May 16, 2013

(65) Prior Publication Data

US 2014/0311508 A1 Oct. 23, 2014

(30) Foreign Application Priority Data

Nov. 7, 2011 (EP) ..... 11008826

(51) Int. Cl.
*A24D 1/02* (2006.01)
*A24D 3/04* (2006.01)
(Continued)

(52) U.S. Cl.
CPC ..... *A24D 1/02* (2013.01); *A24D 1/002* (2013.01); *A24D 1/04* (2013.01); *A24D 3/048* (2013.01); *A24D 3/061* (2013.01)

(58) Field of Classification Search
CPC ..... A24D 3/048; A24D 3/061
See application file for complete search history.

(56) References Cited

U.S. PATENT DOCUMENTS 3,373,750 A * 3/1968 Beam ..... A24D 3/045 131/339
3,530,861 A 9/1970 Carty
(Continued)

FOREIGN PATENT DOCUMENTS

CN 1100612 3/1995
CN 201667985 12/2010
(Continued)

OTHER PUBLICATIONS

Hot-Melt Adhesive; Meler; 2015; http://www.meler.eu/support/adhesives/.*
(Continued)

*Primary Examiner* — Eric Yaary
(74) *Attorney, Agent, or Firm* — Mueting, Raasch & Gebhardt, P.A.

(57) ABSTRACT

The present invention relates to a smoking article (8) comprising a smokeable material and a mouthpiece (1), the mouthpiece comprising at least three segments (2, 3, 5) in axial alignment. One segment defining a cavity (5) is disposed between two other segments (2, 3) and a fluid-containing breakable capsule (6) is arranged in the cavity. A first wrapper (4) circumscribes at least the cavity, wherein the first wrapper comprises a substantially smooth transparent section overlaying at least a part of the cavity, such that the capsule is at least partially visible through the first wrapper. The first wrapper has one or more layers of
(Continued)

transparent varnish applied thereto. The invention further relates to a mouthpiece for a smoking article and a method of producing a smoking article.

20 Claims, 1 Drawing Sheet

(51) Int. Cl.

| | |
|---|---|
| ***A24D 3/06*** | (2006.01) |
| ***A24D 1/00*** | (2006.01) |
| ***A24D 1/04*** | (2006.01) |

(56) References Cited

U.S. PATENT DOCUMENTS

| | | | | | |
|---|---|---|---|---|---|
| 3,884,246 | A | | 5/1975 | Walker | |
| 4,607,647 | A | * | 8/1986 | Dashley | A24D 1/02 131/358 |
| 4,984,589 | A | * | 1/1991 | Riedesser | A24D 1/02 131/360 |
| 6,209,547 | B1 | | 4/2001 | Koller | |
| 6,482,878 | B1 | * | 11/2002 | Chu | C08G 18/12 524/271 |
| 6,595,218 | B1 | | 7/2003 | Koller | |
| 7,878,962 | B2 | | 2/2011 | Karles | |
| 8,042,463 | B2 | | 10/2011 | Sato | |
| 9,723,868 | B2 | | 8/2017 | Griesmayr | |
| 2002/0153017 | A1 | * | 10/2002 | Georgitsis | A24D 3/04 131/331 |
| 2007/0012327 | A1 | * | 1/2007 | Karles | A24D 3/0216 131/337 |
| 2007/0119467 | A1 | | 5/2007 | Akhmetshin | |
| 2008/0185011 | A1 | * | 8/2008 | Sherwood | A24D 3/0225 131/332 |
| 2011/0232658 | A1 | * | 9/2011 | Dube | A24D 3/061 131/275 |
| 2012/0037172 | A1 | * | 2/2012 | Allen | A24D 3/061 131/275 |
| 2012/0325232 | A1 | * | 12/2012 | Yokogawa | A24D 3/061 131/337 |
| 2013/0047999 | A1 | * | 2/2013 | Rushforth | A24D 3/068 131/332 |

FOREIGN PATENT DOCUMENTS

| | | | | | |
|---|---|---|---|---|---|
| EA | 008885 | | | 8/2007 | |
| EP | 0951947 | A1 | * | 10/1999 | B05D 3/067 |
| EP | 1972213 | | | 9/2008 | |
| GB | 437904 | A | * | 11/1935 | A24C 5/565 |
| JP | H01-127495 | | | 8/1989 | |
| JP | 2006-517106 | | | 7/2006 | |
| JP | 2008-539717 | | | 11/2008 | |
| KR | 10-2010-0014354 | | | 2/2010 | |
| RU | 2233602 | | | 8/2004 | |
| WO | WO 2004/068975 | | | 8/2004 | |
| WO | WO 2009/027331 | | | 3/2009 | |
| WO | WO 2009/106374 | | | 9/2009 | |
| WO | WO 2011/038430 | | | 4/2011 | |
| WO | WO2011/077141 | | | 6/2011 | |
| WO | WO 2011/086751 | | | 7/2011 | |
| WO | WO 2011/117743 | | | 9/2011 | |
| WO | WO 2011/118001 | | | 9/2011 | |
| WO | WO 2011118001 | A1 | * | 9/2011 | A24D 3/061 |
| WO | WO 2011/114530 | | | 6/2013 | |

OTHER PUBLICATIONS

Office Action issued in Korea for Application No. 10-2014-7013061 dated Jun. 1, 2016 (11 pages). English translation included.
Russian Office Action for Application No. 2014123195/12 dated Jun. 26, 2015 (6 pages). English translation included.
Japanese Office Action for Application No. P2014-540350 dated Jun. 25, 2015 (14 pages). English translation included.
Office Action issued in China for Application No. 201280054563.8 dated Jan. 25, 2016 (18 pages). English translation included.
Korean Office Action for Application No. 10-2014-7013061 dated Aug. 26, 2015 (13 pages). English translation included.
Office Action issued in Russia for Application No. 2014123195 dated Aug. 18, 2016 (12 pages). English translation included.
PCT International Search Report and Written Opinion for International Application No. PCT/EP2012/004623 dated Apr. 24, 2013 (10 pages).
Search Report issued in Europe for European Patent Application No. 11008826.7 dated May 10, 2012 (6 pages).
Office Action issued in Japan for Application No. 2017-070832 dated Jun. 25, 2018 (15 pages). English translation included.

* cited by examiner

SMOKING ARTICLE WITH VISIBLE CONTENTS

This application is a U.S. National Stage Application of International Application No. PCT/EP2012/004623, filed Nov. 6, 2012, which was published in English on May 16, 2013, International Patent Publication WO2013/068100 Al. International Application No. PCT/EP2012/004623 claims priority to European Application No. 11008826.7 filed Nov. 7, 2011.

The present invention relates to a smoking article comprising a visible, crushable liquid-containing capsule, a mouthpiece for such a smoking article and a method for producing such a smoking article.

Some smoking articles, such as filter cigarettes, typically comprise a cylindrical rod of tobacco cut filler surrounded by a paper wrapper and a cylindrical filter axially aligned in an abutting end-to-end relationship with the wrapped tobacco rod. Conventionally, the wrapped tobacco rod end and the filter are joined by a tipping paper, typically formed of a band of paper material that circumscribes the entire length of the filter and an adjacent portion of the wrapped tobacco rod.

A number of smoking articles in which tobacco is heated rather than combusted have also been proposed in the art. In heated smoking articles, an aerosol is generated by heating a flavour generating substrate, such as tobacco. Known heated smoking articles include, for example, electrically heated smoking articles and smoking articles, in which an aerosol is generated by the transfer of heat from a combustible heat source to a physically separate aerosol forming material. During smoking, volatile compounds are released from the aerosol forming substrate by heat transfer from the heat source and entrained in air drawn through the smoking article. As the released compounds cool they condense to form an aerosol that is inhaled by the consumer.

EP-A-1895863 describes a cigarette, wherein a capsule is provided in between a first absorbent member and a second absorbent member of a filter element. The capsule is adapted to release at least a portion of a fluid when the capsule is subjected to external force, such as squeezing, by the consumer.

Furthermore, smoking articles with transparent sections, such that at least part of the smoking article is visible through the wrapper are known in the art. For instance, WO-A-2009/147122 discloses a smoking article with a tipping material attached to the filter portion of the smoking article, the tipping material comprising at least one transparent section through which a filter segment is at least partly visible. The filter segment may comprise a flavour release segment which may be a cavity filled with at least one of plant leaf, tobacco beads, flavour loaded cellulose beads, one or more flavour containing capsules or flavoured threads. A view on the flavour release segment is enabled by the transparent section. Where the cavity is filled with flavour loaded beads, these are porous and allow for gradual release of the flavour without requiring the consumer to crush or break the beads. Since such beads are suitable for continued release of flavor rather than providing a burst of flavor, the smoking article does not permit a consumer to choose when to activate or release the flavor.

CN 201 667 985 U discloses a filter rod with visible perfume beads, wherein a cavity is formed between tow sections, and one or more of the perfume beads are arranged in the cavity. The perfume beads contain perfume liquid and can optionally be broken by a consumer to emit fragrance. The filter rod further comprises transparent molding paper and tipping paper with a transparent section or transparent tipping paper. However, it is difficult to ensure that the perfume liquid remains substantially in the cavity.

It is thus a preferred object to address these issues.

It is also a preferred object of the invention to provide a smokeable article that allows to visualize the presence and operation of a breakable capsule in the smoking article in an intuitive way.

Breakable capsules are known for delivering a burst of flavor when ruptured. However, it is an issue that the flavor, typically a liquid, can travel through the smokeable article, such as by capillary action, when the capsule is ruptured.

Thus, it is yet another preferred object to reduce or avoid that the liquid released from a breakable article reaches the mouth or hands of the consumer.

Accordingly, the invention provides a smoking article comprising a smokeable material and a mouthpiece in axial alignment with the smokeable material, the mouthpiece comprising at least three segments, one segment defining a cavity disposed between two other segments, the cavity enclosing a fluid-containing breakable capsule, and a first wrapper circumscribing the mouthpiece, wherein the wrapper comprises a substantially smooth transparent section overlaying at least a part of the cavity, such that the capsule is at least partially visible through the wrapper, wherein the first wrapper has one or more layers of transparent varnish applied thereto.

This provides the benefit, that the consumer can see the capsule, and therefore knows how to operate the capsule. In particular, as the consumer can see the capsule before activating the fluid release by rupturing the capsule, this provides an effective and rapid way of notifying the consumer of the presence of the capsule in the smoking article. It further allows the consumer to confirm the intactness of the capsule prior to rupture. Additionally, where rupture is to be caused by the application of pressure against the capsule, it enables the consumer to apply pressure in exactly the right location to achieve an efficient rupture of the capsule. The transparent varnish applied on the first wrapper enables that the first wrapper, which may be transparent, remains substantially or entirely impermeable to fluids, in particular after the capsule is broken. Thus, the fluid released from the capsule does not travel through the first wrapper after being released from the capsule, such that it can be avoided that the liquid reaches the mouth or hands of the consumer.

The invention further provides a mouthpiece for a smoking article, the mouthpiece comprising at least two segments, a cavity being disposed between two of the segments, the cavity enclosing a fluid-containing breakable capsule, and a first wrapper circumscribing at least part of the mouthpiece, wherein the wrapper has one or more layers of transparent varnish applied thereto, and wherein the wrapper comprises a substantially smooth transparent section overlaying at least a part of the cavity, such that the capsule is at least partially visible through the wrapper.

The invention also provides a method of producing a smoking article comprising: providing a plurality of discrete filters comprising two or more filter segments, providing a substantially smooth sheet of transparent material, which has one or more layers of transparent varnish applied thereto, placing the discrete filters in axial alignment with a tobacco rod such that at least two of the filter segments are placed in a spaced apart arrangement so as to define a cavity section, placing a breakable fluid-containing capsule in the cavity section; and wrapping the sheet of transparent material around at least a portion of the discrete filters, the cavity section and the tobacco rod, forming a smoking article.

The capsule may be adapted to release a fluid material, when the capsule is subjected to external force or pressure, such as squeezing, by the consumer. In particular, the capsule may release a liquid material. The capsule thus comprises a breakable wall. In some embodiments, several capsules may be provided in a cavity, though it is preferred that a single capsule is located in the cavity.

The capsule may contain an additive, which modifies the characteristics of the smoke of the smoking article. Such additives may comprise flavours, neutralizing agents, or other smoke modifiers, such as chemical reagents. Additionally, the additives may also include diluents, solvents or processing aids. In a preferred embodiment, the additive is one or more flavorants, such as a liquid flavour, flavour formulation or flavour-containing material. Suitable capsules as well as their manufacture are known in the art. An example of capsules that can be used in the present context are described in WO-A-2007/010407.

The transparent section of the first wrapper is substantially smooth. By "substantially smooth" it is meant that the transparent section does not have a pattern or image impressed onto its surface such that the pattern or image is raised from the overall surface. In particular, the surface of the transparent section of the filter element has only a normal surface roughness inherent to the respective material. That means that the transparent section in this embodiment is not embossed. This provides an advantageous feature that the transparent section can be located not only visually but also preferably by touch since the smooth section will typically have a different feel from the sections surrounding it.

The term "transparent" is used to describe a material which allows at least a significant proportion of incident light to pass through, so that it is possible to see through the material. In the present invention, the transparent section allows sufficient light to pass through it such that capsule is visible in the filter element. The transparent section may be completely transparent. Alternatively, the transparent section may have a lower level of transparency while still transmitting sufficient light such that the capsule is visible from the outside of the filter element. Preferably, "transparent" denotes a total percentage light transmission of 40% or more, more preferably 50% or more, even more preferably 60% or more, most preferably 70% or more, as measured using a Hunterlab Colorquest XE Spectrophotometer.

In some cases, the substantially transparent section of the wrapper may be tinted or colored, or may have repeating patterns or other type of graphics applied thereto as long as such patterns or graphics are not raised from the overall surface of the sheet.

The first wrapper is usually an inner wrapper. Thus, the substantially smooth first wrapper may form a circumferential wall for the cavity. The first wrapper may only be partially transparent, such as by comprising transparent window portions, while otherwise being at least partially printed or formed of an opaque material. In other embodiments, substantially all of the first wrapper may be transparent. The thickness of the first wrapper is preferably at least about 25 micrometers, more preferably between about 25 micrometers and about 45 micrometers. The base weight of the first wrapper is preferably at least about 40 grams per square meter (gsm) and more preferably between about 40 gsm and about 65 gsm. In a particularly preferred aspect, the first wrapper is a transparent film.

Preferably, the first wrapper is substantially air impermeable. It may be biodegradable. Examples of suitable materials for use as wrapper materials include polymers and cellulose-based materials. Transparent cellulose film is preferred and cellophane is particularly preferred. This is because cellophane is biodegradable. Other biodegradable polymers may also be suitable. Polypropylene may be suitable since it is substantially impermeable to fluid.

The first wrapper is covered with a transparent varnish. Throughout the specification, the term 'varnish' is used to denote a liquid coating that solidifies upon curing. Curing can be performed using any known standard technique, though ultraviolet curing is preferred.

Suitable varnishes for use in the present invention are known in the art and commercially available from, for example, Schmid Rhyner AG of Adliswil, Switzerland. An example of a particularly preferred varnish is a nitrocellulose lacquer. Such a lacquer can further improve air impermeability of the first wrapper. The transparent varnish is preferably provided on the inside of the first wrapper. In particular, the transparent varnish may be applied by printing.

In one embodiment, multiple layers of transparent varnish can be provided on the first wrapper.

In a further aspect, an opaque second wrapper comprising at least one opening may be provided around the first wrapper. The second or outer wrapper may be formed by using paper with a weight from about 40 to about 60 gsm. The at least one opening may be formed by a die-cut. The, or each, opening forms a window, through which the capsule can be seen.

Alternatively, the outer wrapper may comprise a transparent film, while the first wrapper is preferably only at least partially formed from a transparent film.

An outer wrapper made from a transparent film preferably has a weight of about 40 gsm to about 90 gsm.

In one embodiment, the at least one opening is a die-cut opening. This facilitates the production of an outer wrapper, which may be die-cut before being used in a standard cigarette manufacturing equipment.

In another embodiment, the outer wrapper may only cover part of the filter element, namely substantially the upstream segment. A further outer wrapper may be provided, which covers the downstream segment, such that the cavity is not covered by the outer wrappers. In this case, the outer wrappers can both be opaque.

As used herein, the terms 'upstream' and 'downstream' are used to describe the relative position of portions or components of mouthpieces and smoking articles according to the invention in relation to the direction of mainstream smoke drawn through the mouthpieces and smoking articles during use thereof. For example, in a mouthpiece where the cavity is upstream of a mouth end segment, mainstream smoke is drawn first through the cavity and then through the mouth end segment.

In one embodiment, the diameter of the capsule relative to the diameter of the cavity is such that the capsule is substantially immobilized inside the cavity. For instance, the relative diameter of the capsule may be about 88% to about 99% of the diameter of the cavity. This renders the capsule easy to locate and rupture whilst still allowing air to flow past the unruptured capsule. In another embodiment, the relative diameter of the capsule to the cavity is such that it is mobile within the cavity. For instance the capsule may be about 60 to about 87% of the diameter of the cavity. This improves the visibility of the capsule as a separate element and allows the capsule to move inside the cavity to attract further attention of the consumer. Furthermore, the cavity being larger than the capsule provides a better visibility of the release of the fluid, when the capsule is opened. Nevertheless, it is important that the capsule is not so small that it becomes very difficult for a consumer to crush. For instance, a capsule having a relative diameter of about 30% or less compared to the diameter of the cavity is not preferred.

Preferably, the segments either side of the cavity are adapted such that the main fraction of the fluid of the capsule remains in the cavity when the capsule is broken. However, the fluid may be slowly absorbed by the segments. Nevertheless, immediately following breakage of the capsule, the visibility of free fluid in the cavity is beneficial as it confirms activation of the fluid release to the consumer.

Preferably, the segments comprise at least one of filter tow material or sorbents such as for example, carbon, carbon beads or a carbon structure, activated carbon, active aluminum, zeolites, sepiolites, molecular sieves and silica gel. The filtration material in the filter segment is useful for the removal of particulate and gaseous components of the mainstream smoke. A carbon structure is known in the art, for example in the form of an extruded carbon honeycomb structure. Such a carbon structure is disclosed for example in the Japanese patent application JP-A 2001-120250. It is particularly preferred that the filter segments comprise a cellulose acetate tow, which may be aligned or randomly oriented.

The fluid released from the ruptured capsule may travel slowly through the filter segment dues to a capillary effect. However, the filter segments may be at least partially rendered less absorbent to fluid, for example by coating or sealing, so that the movement of fluid through the filter segment is slowed. This has the advantage of making the fluid visible in the cavity for a longer period.

Preferably, the fluid in the capsule is colored. Thus, the visibility of the release of the fluid is improved.

Additionally or alternatively, the capsule may be colored. In particular, the walls of the capsule may be colored. Thus, the visibility of the capsule in the cavity is improved. Furthermore, if the fluid and the capsule are provided in different colors, the visibility of the release of the fluid may be yet further improved.

The color of the capsule or the fluid comprised in the capsule is preferably different from the color of the remaining filter element.

Preferably, the cavity is arranged between a mouth end filter segment and a rod end filter segment, wherein the mouth end filter segment is longer than the rod end filter segment. This has the advantage of preventing the fluid from the opened capsule from reaching a consumer's mouth by means of capillary effect. Preferably, the filter segments are segments comprising a filter tow. The rod end filter segment preferably may have a length up to about 12 mm. The cavity preferably may have a length up to about 7 mm. The mouth end filter segment preferably may have a length of at least 15 mm. The capsule preferably has a spherical or ellipsoidal form with a diameter of about 4.5 mm. In some embodiments, perforations may be provided in the rod end filter segment, which allow a dilution of the smoke with air in the rod end filter segment.

The filter may also comprise more than two filter segments wrapped in and connected by the first wrapper. For instance, up to five segments may be present. The different segments may comprise filtration materials, absorbent materials, flavours, plant materials, botanicals or spices. Some or all of these segments may be at least partially visible through transparent sections of the filter element.

Preferably the smokeable material comprises a tobacco rod.

Preferably, a wrapper, namely the first wrapper or the outer wrapper, is at least partially wrapped around the mouthpiece and the tobacco rod, to connect the mouthpiece and the tobacco rod.

Thus, the invention further relates to a smoking article according to the present invention, wherein an outer wrapper is at least partially wrapped around mouthpiece in the form of the filter element and a tobacco rod, to connect the filter element and the tobacco rod. The outer wrapper may circumscribe the filter element along the entire length of the filter element.

Smoking articles according to the present invention may be filter cigarettes or other smoking articles in which smokeable material, in particular tobacco material, or another combustible material is combusted to form smoke. Alternatively, smoking articles according to the invention may be articles in which material is heated to form an aerosol, rather than combusted. In one type of heated smoking article, tobacco material or another aerosol generating material is heated by one or more electrical heating elements to produce an aerosol. In another type of heated smoking article, an aerosol is produced by the transfer of heat from a combustible or chemical heat source to a physically separate aerosol forming material, which may be located within, around or downstream of the heat source.

The capsule is visible through at least one opening. Alternatively, several openings may be provided around the circumference of the outer wrapper in the region of the cavity.

Filters that comprise a cavity as used in the smoking article according to the invention may be produced using known machinery for producing charcoal filters, such as that described in EP-A-1,571,933. Such machinery is commercially available, for example from Filtrona International Ltd., Great Britain.

Preferably, the overall length of smoking articles according to the present invention is between about 70 mm and about 128 mm, more preferably about 84 mm.

Preferably, the external diameter of filters and smoking articles according to the present invention is between about 3 mm and 8.5 mm, more preferably about 7.9 mm.

Preferably, the overall length of filters according to the present invention is between about 18 mm and about 36 mm, more preferably about 27 mm.

Preferably, the length of each individual segment of filters according to the present invention is between about 5 mm and about 22 mm.

In smoking articles according to the invention, the mouth end segment of the filter may comprise a hollow tube or recess. The hollow tube or recess may be formed when the filter is attached to a rod of smokeable material by, for example, tipping paper to form a smoking article according to the present invention. Preferably, the recess further comprises a cylindrical element that adds structural strength to the tube, for example a paper or carton tube that is overwrapped by the tipping material. Recess filters are well known in the art, for example, in WO-A-2004/089124.

In smoking articles according to the invention, the filter may comprise a restrictor segment. A restrictor segment affects the resistance to draw and other fluid dynamics of the smoking article and also affects the formation of carbon monoxide and carbon dioxide. Restrictors in smoking articles are known in the art, for example from the International patent application WO-A2-2008/059377.

Filters according to the present invention may be produced by forming separate continuous rods comprising multiple units of each individual segment of the filter. Then these separate rods are combined in a known manner in one or more stages to form a continuous filter rod comprising multiple units of the filter. The continuous filter rod may then be subsequently severed at regular intervals by a cutting mechanism to yield a succession of discrete filters according to the invention.

Preferably, smoking articles according to the present invention comprise a wrapped rod of tobacco cut filler. Preferably, smoking articles according to the present invention have a total nicotine free dry particulate matter (NFDPM) or "tar" delivery of up and about 10 mg. More preferably, the "tar delivery" is between 1 mg and 10 mg and more preferably about 6 mg.

Smoking articles according to the present invention may be packaged in containers, for example in soft packs or hinge-lid packs, with an inner liner coated with one or more flavorants.

The invention will now be further described with reference to exemplary embodiments as shown in the following figures.

Figure 1:
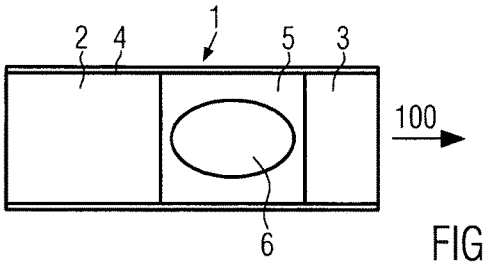
FIG. 1 shows a cross sectional view of a filter element according to one embodiment of the invention.

FIG. 1 shows a mouthpiece in the form of a filter element 1 for a smoking article according to a first embodiment of the invention. The filter element 1 has a substantially cylindrical form. In particular, it comprises a mouth end filter segment 2 and, spaced apart from the mouth end filter segment, a rod end filter segment 3. By "spaced apart", it is meant that the segments are not in an abutting or adjacent relationship. Both the mouth end filter segment 2 and the rod end filter segment 3 have a substantially cylindrical form. Preferably, the filter segments 2, 3 are formed from cellulose acetate, such that they are able to filter the smoke or aerosol provided by the smoking article comprising the filter element 1.

A first wrapper 4, in particular an inner wrapper in the form of a plug wrap, is wrapped around and connects both filter segments 2, 3. The first wrapper 4 is a transparent, impermeable film, in particular made of cellophane. The first wrapper preferably fully circumscribes the mouth end filter segment 2 and the rod end filter segment 3.

The mouth end filter segment 2 and the rod end filter segment 3 are spaced apart and a cavity 5 is provided between them. In particular, the first wrapper 4 forms the outer circumferential wall of the cavity 5, while the mouth end filter segment 2 and the rod end filter segment 3 form the boundary of the cavity 5 in the longitudinal direction 100 of the filter element 1. The longitudinal direction 100 corresponds to the axial direction of the cylindrical filter element 1.

The first wrapper 4 is preferably substantially impermeable to fluid. The impermeability is in particular improved by providing a transparent varnish in the form of nitrocellulose lacquer on the inner side of the first wrapper 4.

Inside the cavity 5 a capsule 6 is located, wherein the capsule 6 encloses a fluid. In particular, the capsule 6 is a breakable capsule, which releases the fluid when it is subjected to sufficient pressure to cause its rupture. Other mechanisms for rupturing the capsule can be provided, such as rupture when the capsule 6 is subjected to smoke or heat but pressure is most preferred.

In the presently exemplified embodiment, the fluid is released from the capsule 6, when the consumer applies a pressure on the filter element 1 in the region of the cavity 5, such that the first wrapper 4 comes into contact with capsule 6, and pressure is applied to the capsule 6. Thus, the wall of the capsule 6 breaks such that the fluid is released into the cavity 5, and may be visible from the outside, as the first wrapper 4 is transparent. However, as the first wrapper 4 is substantially impermeable, the fluid material will substantially remain in the cavity 5, until it is evaporated or absorbed by either the mouth end filter segment 2, the rod end filter segment 3, or both. Preferably, the fluid comprised in the capsule 6 is colored, such that the release of the fluid is visible. In particular, the fluid comprised in the cavity 5 may have a color which is different from the remaining filter element 1, to improve the visibility thereof. More preferably, the color of the fluid may also be different from the outer wall of the capsule 6 enclosing the fluid. The fluid may be formed of or comprise an additive or flavour. Additives may modify the smoke provided by the smoking article, while flavourants may in particular modify the taste or flavour of the smoke of the smoking article. In particular, the fluid of the capsule 6 may provide a menthol taste. Thus, at a desired time during the smoking of the smoking article, the consumer can activate the additional menthol taste, by pressing the filter element 1 with sufficient force to rupture the capsule wall, such that the fluid is released and by means of evaporation of the fluid, the menthol taste will be delivered through the mouth end filter segment together with the smoke. As the first wrapper 4 is transparent, the consumer can readily confirm the release of the fluid.

Figure 2:
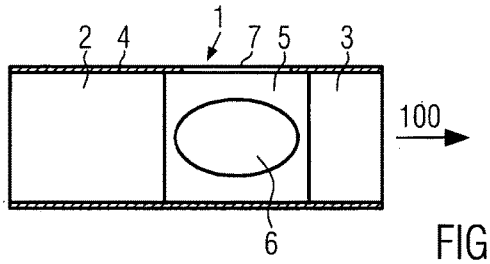
FIG. 2 shows a cross sectional view of a filter element according to another embodiment of the invention.

FIG. 2 shows a second embodiment of a mouthpiece in the form of a filter element 1, which is substantially the same as the first embodiment of the filter element 1, with a different first wrapper 4. The first wrapper 4 is generally opaque, and only comprises a transparent window 7 in the region of the cavity 5. In particular, the first wrapper 4 may be a transparent film, and opacity is achieved by printing the wrapper with an opaque ink in its entirety apart from the region of the window 7. In other embodiments, the window 7 may be created by treatment of an otherwise opaque material, such as a thin paper, to make it transparent in the region of the window 7. In yet other embodiments, the first wrapper 4 may be made of an opaque material with an opening formed therein, wherein the opening is overlayed or underlayed with a transparent material to form the window 7. The transparent material may in particular be fixed by means of adhesive to the remaining material of the first wrapper 4.

The transparent window 7 has a length in the longitudinal direction 100, which is substantially equal or less than the distance between the filter segments 2, 3. Furthermore, the window 7 may have a width, which is the same or less than the circumference of the first wrapper 4. In particular, several windows 7 may be provided in the circumferential direction or in the longitudinal direction of the first wrapper 4 in the region of the cavity 5.

Figure 3:
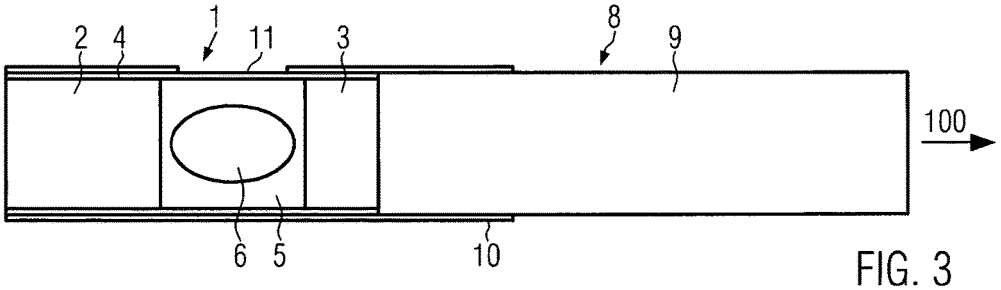
FIG. 3 shows a cross sectional view of a smoking article according to one embodiment of the invention.

In FIG. 3, a first embodiment of a smoking article 8 according to the invention is shown in a cross section. The smoking article 8 comprises the filter element 1 as described with respect to FIG. 1 and a smoking material rod 9, in axially aligned arrangement in the longitudinal direction 100. The rod end filter segment 3 abuts the smoking material rod 9. An outer wrapper 10 is wrapped around the filter element 1 and at least a portion of the smoking material rod 9, to connect the smoking material rod 9 and the filter element 1. The outer wrapper 10 fully circumscribes at least a portion of the smoking material rod 9 and the filter element 1. The outer wrapper 10 may be fixed by means of adhesive to the smoking material rod 9 and the filter element 1.

The smoking material rod 9 is in particular a cylindrical rod of tobacco material which is comprised in a cigarette paper.

The outer wrapper 10 is made from opaque material, such as standard tipping paper. The outer wrapper 10 comprises an opening 11 in the region of the cavity 5. Thus, as the first wrapper 4 is transparent, the inside of the cavity 5, and therefore the capsule 6, is visible from the outside of the smoking article 8 through the opening 11. The opening 11 forms a window in the outer wrapper 10. The window formed by the opening 11 has in particular a length in the longitudinal direction, which is substantially equal to or less than the distance in between the filter segments 2, 3. Furthermore, the window may have a width, which is the same or less as the circumference of the outer wrapper 10. In particular, several windows may be provided in the circumferential direction or in the longitudinal direction of the outer wrapper 10 in the region of the cavity 5.

The opening 11 is in particular a die-cut opening in the outer wrapper 10. However, in other embodiments, instead of the opening 11, a transparent window may be provided in the outer wrapper 10. Furthermore, several openings 11 in the outer wrapper 10 may be provided in the region of the cavity 5 of the filter element 1. In particular, a plurality of openings 11 may be arranged spaced from each other in the longitudinal direction or circumferential direction of the outer wrapper 10 in the region of cavity 5.

Figure 4:
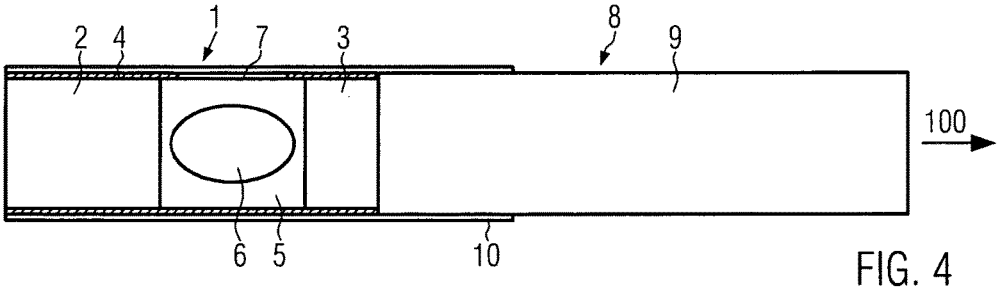
FIG. 4 shows a cross sectional view of a smoking article according to another embodiment of the invention.

In FIG. 4, a second embodiment of a smoking article 8 with a filter element 1 according to FIG. 2 is shown. In this embodiment, the outer wrapper 10 is made from a substantially transparent material, while the first wrapper 4 is only transparent in a window 7 in the region of the cavity 5. Thus, the cavity 5 and the capsule 6 will be visible through the window 7.

In a further embodiment of the present invention, the first wrapper 4 and the outer wrapper 10 may be fully transparent. Thus, the filter segments 2, 3 as well as the cavity 5 are visible from the outside. However in other embodiments, it is preferred that only the cavity 5 is visible from the outside, and thus the transparent outer wrapper may be partially printed.

Figure 5:
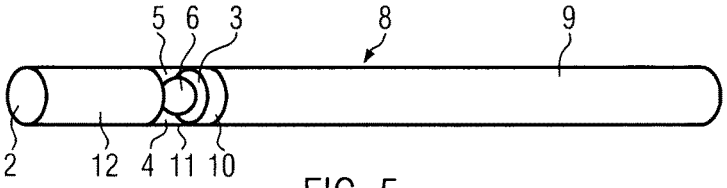
FIG. 5 shows a perspective side view of a smoking article according to an embodiment of the invention.

In FIG. 5, a smoking article 8 is shown, in which the whole cavity 5 is visible through a transparent first wrapper 4. An outer wrapper 10 is provided in the region of the rod end filter segment 3 and a neighboring portion of the smoking material rod 9. An further outer wrapper 12 is provided in the region of the mouth end filter segment 2. The outer wrappers 10, 12 are arranged in a spaced apart relationship, such that the capsule 6 is visible from the outside of the smoking article 8. As the fluid comprised in the capsule 6 is colored, the fluid release will be visible by the free colored fluid in the cavity 6.

Thus, in FIG. 5 the opening 11 in the outer wrapper 10, 12 fully extends around the circumference of outer wrapper 10, 12, and the outer wrapper 10, 12 is in fact formed by two separate outer wrappers 10, 12, wherein one wrapper 12 is mainly arranged around the mouth end filter segment 2, while the other outer wrapper 10 is mainly arranged in the region of the rod end filter segment 3 and the neighboring end of the smoking material rod 9. The outer wrapper 12 forms the circumferential outside of the mouth end of the filter element 1, while the other outer wrapper 10 is provided for connecting the filter element 1 and the smoking material rod 9.

Thus, the opening 11 in the outer wrapper 10 may be provided in the whole region of the cavity 5, such that only the filter segments 2, 3 are covered by the outer wrappers 10, 12. Therefore, the cavity 5 and the capsule 6 therein are fully visible from the outside.

Further, in some embodiments, the outer wrapper 10 may only extend in the region of the rod end filter segment 3 and the smoking material rod 9, and no outer wrapper is provided around the mouth end filter segment 2. Then, the first wrapper 4 forms the circumferential outside of the mouth end of the smoking article 8.

The invention claimed is:

1. A smoking article comprising a smokeable material and a mouthpiece, the mouthpiece comprising at least three segments in axial alignment, one segment defining a cavity disposed between two other segments, a fluid-containing breakable capsule arranged in the cavity, and a first wrapper circumscribing at least the cavity, wherein the first wrapper comprises a substantially smooth transparent section overlaying at least a part of the cavity, such that the capsule is at least partially visible through the first wrapper, wherein the first wrapper has one or more layers of transparent nitrocellulose lacquer varnish applied thereto.

2. The smoking article according to claim 1, wherein the cavity is arranged in between a downstream segment and an upstream segment, wherein the downstream segment is longer than the upstream segment.

3. The smoking article according to claim 1, wherein an opaque second wrapper comprising at least one opening is provided around the first wrapper and the at least one opening overlays the transparent section of the first wrapper.

4. The smoking article according to claim 1, wherein the downstream and upstream segments reduce or prevent the release of fluid from the capsule, when ruptured, from the cavity.

5. The smoking article according to claim 1, wherein the fluid in the capsule is colored.

6. The smoking article according to claim 1, wherein the capsule is colored.

7. The smoking article according to claim 1, wherein the diameter of the capsule relative to the diameter of the cavity is such that the capsule is substantially immobilized inside the cavity.

8. The smoking article according to claim 1, wherein the diameter of the capsule relative to the diameter of the cavity is such that it is mobile within the cavity.

9. The smoking article according to claim 1, wherein the smokeable material is a tobacco rod and an outer wrapper is at least partially wrapped around the mouthpiece and the tobacco rod, to connect the mouthpiece and the tobacco rod.

10. The smoking article according to claim 9, wherein the outer wrapper is made from a transparent film.

11. The smoking article according to claim 9, wherein the outer wrapper is opaque and comprises at least one opening overlaying the transparent section of the first wrapper.

12. A mouthpiece for a smoking article, the mouthpiece comprising at least three segments, one segment defining a cavity and being disposed between two other segments, a fluid-containing breakable capsule arranged in the cavity, and a first wrapper circumscribing at least the cavity, wherein the first wrapper has one or more layers of transparent nitrocellulose lacquer varnish applied thereto, and wherein the first wrapper comprises a substantially smooth transparent section overlaying at least a part of the cavity, such that the capsule is at least partially visible through the first wrapper.

13. A method of producing a smoking article comprising:

providing a plurality of discrete filters comprising two or more filter segments, providing a substantially smooth sheet of at least partially transparent material, which has one or more layers of transparent nitrocellulose lacquer varnish applied thereto, placing the discrete filters in axial alignment such that at least two of the filter segments are placed in a spaced apart arrangement so as to define a cavity section, placing a breakable fluid-containing capsule in the cavity section; and wrapping the sheet of at least partially transparent material around at least a portion of the discrete filters and the cavity section, and wrapping a further wrapper around the discrete filters and a tobacco rod, forming a smoking article.

14. The method according to claim 13, wherein the filter segments comprise a downstream filter segment and an upstream filter segment, wherein the downstream filter segment is longer than the upstream filter segment.

15. The smoking article according to claim 2, wherein an opaque second wrapper comprising at least one opening is provided around the first wrapper and the at least one opening overlays the transparent section of the first wrapper.

16. The smoking article according to claim 2, wherein the downstream and upstream segments reduce or prevent the release of fluid from the capsule, when ruptured, from the cavity.

17. The smoking article according to claim 3, wherein the downstream and upstream segments reduce or prevent the release of fluid from the capsule, when ruptured, from the cavity.

18. The smoking article according to claim 2, wherein the fluid in the capsule is colored or the capsule is colored.

19. The smoking article according to claim 3, wherein the fluid in the capsule is colored or the capsule is colored.

20. The smoking article according to claim 4, wherein the fluid in the capsule is colored or the capsule is colored.

* * * * *